US005536612A

United States Patent [19]

Yamaguchi et al.

[11] Patent Number: 5,536,612

[45] Date of Patent: Jul. 16, 1996

[54] ENCAPSULATED TONER FOR HEAT-AND-PRESSURE FIXING AND METHOD FOR PRODUCTION THEREOF

[75] Inventors: Takashi Yamaguchi, Arida; Mitsuhiro Sasaki, Wakayama; Tetsuya Asano, Wakayama; Kuniyasu Kawabe, Wakayama, all of Japan

[73] Assignee: Kao Corporation, Tokyo, Japan

[21] Appl. No.: 206,392

[22] Filed: Mar. 7, 1994

[30] Foreign Application Priority Data

Mar. 10, 1993 [JP] Japan ..... 5-077707

[51] Int. Cl.[6] ..... G03G 9/087

[52] U.S. Cl. ..... 430/137; 430/109; 523/201

[58] Field of Search ..... 430/137, 138, 430/109; 523/201; 525/903

[56] References Cited

U.S. PATENT DOCUMENTS

| | | | |
|---|---|---|---|
| 2,297,691 | 10/1942 | Carlson . | |
| 2,357,809 | 9/1944 | Carlson . | |
| 3,269,626 | 8/1966 | Albrecht . | |
| 3,657,172 | 4/1972 | Gallagher et al. | 523/201 |
| 3,788,994 | 1/1974 | Wellman et al. . | |
| 4,533,617 | 8/1985 | Inoue et al. . | |
| 4,601,968 | 7/1986 | Hyosu . | |
| 4,626,489 | 12/1986 | Hyosu . | |
| 5,035,970 | 7/1991 | Hsieh et al. | 430/109 |
| 5,153,093 | 10/1992 | Sacripante et al. | 430/138 |
| 5,204,205 | 4/1993 | Anno et al. | 430/138 |
| 5,244,768 | 9/1993 | Inaba . | |

FOREIGN PATENT DOCUMENTS

| | | |
|---|---|---|
| 0552785 | 7/1993 | European Pat. Off. . |
| 2192730 | 1/1988 | United Kingdom . |

OTHER PUBLICATIONS

Abstract, Database WPI, Derwent Publications Ltd., London, GB; AN 92–360230 [44] & JP–A–4 260 055 (Fuji Xerox) 16 Sep. 1992.

Abstract, Database WPI, Derwent Publications Ltd., London, GB; AN 93–040254 [05] & JP–A–4 365 052 (Fuji Xerox) 17 Dec. 1992.

English abstract of JP–48/75033.
English abstract of JP–61/56352.
English abstract of JP–63/128357.
English abstract of JP–63/128358.
English abstract of JP–63/128359.
English abstract of JP–63/128360.
English abstract of JP–63/128361.
English abstract of JP–63/128362.
English abstract of JP–63/281168.
English abstract of JP–4/184358.
English abstract of JP–59/61843.
English abstract of JP–91035660.
English abstract of JP–59/62869.
English abstract of JP–59/61844.
English abstract of JP–59/61842.
English abstract of JP–2/223961.
English abstract of JP–1/267565.
English abstract of JP–1/265262.
English abstract of JP–1/238674.
English abstract of JP–1/299802.
English abstract of JP–59/62868.

*Primary Examiner*—Christopher D. Rodee
*Attorney, Agent, or Firm*—Birch, Stewart, Kolasch & Birch

[57] ABSTRACT

A method for producing an encapsulated toner for heat-and-pressure fixing, which has a heat-fusible core material containing at least a thermoplastic resin and a coloring agent and a shell formed thereon so as to cover the surface of the core material, having the steps of coating the surface of the core material with a hydrophilic shell-forming material to form precursor particles; adding at least a vinyl polymerizable monomer and an initiator for vinyl polymerization to an aqueous suspension of the precursor particles to absorb them into the precursor particles; and then polymerizing the monomer components in the precursor particles. The method of the present invention offers toners which not only have improved storage stability but also are excellent in offset resistance, fixable at a low temperature and are further capable of forming clear images free from background.

6 Claims, No Drawings

ENCAPSULATED TONER FOR HEAT-AND-PRESSURE FIXING AND METHOD FOR PRODUCTION THEREOF

BACKGROUND OF THE INVENTION

1. Field of the Invention

The present invention relates to an encapsulated toner for heat-and-pressure fixing used for development of electrostatic latent images in electrophotography, electrostatic printing, or electrostatic recording, and to a method for production thereof.

2. Discussion of the Related Art

As described in U.S. Pat. Nos. 2,297,691 and 2,357,809 and other publications, conventional electrophotography comprises the steps of forming an electrostatic latent image by evenly charging a photoconductive insulating layer and subsequently exposing the layer to eliminate the charge on the exposed portion and visualizing the formed image by adhering colored charged fine powder known as a toner to the latent image (a developing process); transferring the obtained visible image to an image-receiving sheet such as a transfer paper (a transfer process); and permanently fixing the transferred image by heating, pressure application or other appropriate means of fixing (a fixing process).

As stated above, a toner must meet the requirements not only in the development process but also in the transfer process and fixing process.

Generally, a toner undergoes mechanical frictional forces due to shear force and impact force during the mechanical operation in a developer device, thereby deteriorating after copying from several thousands to several ten thousands of sheets. Such deterioration of the toner can be prevented by using a tough resin having such a high molecular weight that it can withstand the above mechanical friction. However, this kind of a resin generally has such a high softening point that the resulting toner cannot be sufficiently fixed by a non-contact method such as oven fixing or radiant fixing with infrared rays, because of its poor thermal efficiency. Further, when the toner is fixed by a contact fixing method such as a heat-and-pressure fixing method using a heat roller, which is excellent in thermal efficiency and therefore widely used, it becomes necessary to raise the temperature of the heat roller in order to achieve sufficient fixing of the toner, which brings about such disadvantages as deterioration of the fixing device, curling of paper and an increase in energy consumption. Furthermore, the resin described above is poor in grindability, thereby remarkably lowering the production efficiency of the toner upon the production of the toner. Accordingly, a binding resin having a too increased degree of polymerization and also a too high softening point cannot be used.

Meanwhile, according to the heat-and-pressure fixing method using a heat roller, the surface of a heat roller contacts the surface of a visible image formed on an image-receiving sheet under pressure, so that the thermal efficiency is excellent and therefore widely used in various copying machines from high-speed ones to low-speed machines. However, when the surface of a heat roller contacts the surface of the visible image, the toner is likely to cause a so-called "offset phenomenon," wherein the toner is adhered to the surface of the heat roller, and thus transferred to a subsequent transfer paper. In order to prevent this phenomenon, the surface of a heat roller is coated with a material excellent in release properties, such as a fluororesin, and further a releasing agent such as a silicone oil is applied thereon. However, the method of applying a silicone oil, necessitates a larger-scale fixing device, which is not only expensive but also complicated, which in turn may undesirably result in various problems.

Although processes for improving the offset phenomenon by unsymmetrizing or crosslinking the resins have been disclosed in Japanese Patent Examined Publication No. 57-493 and Japanese Patent Laid-Open Nos. 50-44836 and 57-37353, the fixing temperature has not yet been improved by these processes.

Since the lowest fixing temperature of a toner is generally between the temperature of low-temperature offsetting of the toner and the temperature of the high-temperature offsetting thereof, the serviceable temperature range of the toner is from the lowest fixing temperature to the temperature for high-temperature offsetting. Accordingly, by lowering the lowest fixing temperature as much as possible, and by raising the temperature causing high-temperature offsetting as much as possible, the serviceable fixing temperature can be lowered and the serviceable temperature range can be widened, which enables energy saving, high-speed fixing and prevention of curling of paper.

From the above reasons, the development of a toner excellent in fixing ability and offset resistance has always been desired.

There has been proposed a method for achieving low-temperature fixing by using an encapsulated toner comprising a core material and a shell formed thereon so as to cover the surface of the core material.

Among such toners, those having a core material made of a low-melting wax which is easily plastically deformable, as described in U.S. Pat. No. 3,269,626, Japanese Patent Examined Publication Nos. 46-15876 and 44-9880, and Japanese Patent Laid-Open Nos. 48-75032 and 48-75033, are poor in fixing strength and therefore can be used only in limited fields, although they can be fixed only by pressure.

Further, with respect to toners having a liquid core material, when the strength of the shell is low, the toners tend to break in the developing device and stain the inside thereof, though they can be fixed only by pressure. On the other hand, when the strength of the shell is high, a higher pressure is necessitated in order to break the capsule, thereby giving too glossy images. Thus, it has been difficult to control the strength of the shell.

Further, there has been proposed, as a toner for heat-and-pressure fixing, an encapsulated toner for heat roller fixing which comprises a core material made of a resin having a low glass transition temperature which serves to enhance the fixing strength, though blocking at a high temperature may take place if used alone, and a shell of a high-melting point resin wall which is formed by interfacial polymerization for the purpose of imparting a blocking resistance to the toner. However, in Japanese Patent Laid-Open No. 61-56352, this toner cannot fully exhibit the performance of the core material, because the melting point of the shell material is too high and also the shell is too tough and not easily breakable. On the same line of thinking as that described above, encapsulated toners for heat roller fixing with an improved fixing strength of the core material have been proposed (see Japanese Patent Laid-Open Nos. 58-205162, 58-205163, 63-128357, 63-128358, 63-128359, 63-128360, 63-128361 and 63-128362). However, since these toners are prepared by a spray drying method, a higher load to the equipments for the production thereof becomes necessary. In addition, they cannot fully exhibit the performance of the core material, because they have not come up with a solution for the problems associated with the shell.

Further, in the encapsulated toner proposed in Japanese Patent Laid-Open No. 63-281168, the shell is made of a thermotropic liquid crystal polyester, and in the encapsulated toner proposed in Japanese Patent Laid-Open No. 4-184358, a crystalline polyester is used. Since each of the polyesters used in these references is not amorphous, the resin sharply melts. However, the amount of energy required for fusion is large. Further, the Tg of the core material is also high, making the fixing ability of the resulting toner poor.

Also, in the methods for production of toners disclosed in Japanese Patent Examined Publication Nos. 4-41344, 2-41748 and 3-35660, a seed polymerization is employed. When materials having low glass transition temperatures are used for their core materials in these methods, the resulting toners have a poor storage stability because the precursor particles are not encapsulated.

Further, there has been attempted to control the chargeability of the encapsulated toner in the presence of a charge control agent in the shell of the encapsulated toner or on the surface of the encapsulated toner. However, in the developing process, the charge control agent becomes detached from the toner due to friction with the carrier to adhere onto the carrier, and the tribo electric charge of the resulting toner is lowered, thereby causing such problems as background and scattering of the toner in the developer device. In addition, when no charge control agents are present on the surface of the toner, charging speed may become slow depending upon the type of carriers, thereby causing background, or scattering of the toner in the case of quick printing.

SUMMARY OF THE INVENTION

An object of the present invention is to provide a method for production of an encapsulated toner for heat-and-pressure fixing which is excellent in offset resistance, fixable even at a low temperature and excellent in blocking resistance when the encapsulated toner is used for heat-and-pressure fixing using a heat roller.

Another object of the present invention is to provide an encapsulated toner produced by such a method.

As a result of intensive research in view of solving the above-mentioned problems, the present inventors have found that clear visible images free from background can be stably formed for a large volume of copying by using an encapsulated toner which is produced by the steps comprising preparing a core material while adjusting the amount of the crosslinking agents used and the Tg of the resin components in the core material in order to improve its offset resistance and fixing ability; and forming a shell on the surface of the core material with a hydrophilic shell-forming material such as an amorphous polyester resin. Specifically, in a heat-and-pressure fixing method using a heat roller, etc., the present inventors have found that the encapsulated toner for heat-and-pressure fixing, which is excellent in offset resistance, fixable even at a low temperature and also excellent in storage stability, can be obtained by controlling the distribution of the low-molecular weight components and the high-molecular weight components in the toner and by using a shell-forming material composition with an excellent blocking resistance, and have thus completed the present invention.

More particularly, the gist of the present invention is as follows:

(1) A method for producing an encapsulated toner for heat-and-pressure fixing comprising a heat-fusible core material containing at least a thermoplastic resin and a coloring agent and a shell formed thereon so as to cover the surface of the core material, the method comprising the steps of coating the surface of the core material with a hydrophilic shell-forming material to form precursor particles; adding at least a vinyl polymerizable monomer and an initiator for vinyl polymerization to an aqueous suspension of the precursor particles to absorb them into the precursor particles; and then polymerizing the monomer components in the precursor particles; and (2) An encapsulated toner for heat-and-pressure fixing comprising a heat-fusible core material containing at least a thermoplastic resin and a coloring agent and a shell formed thereon so as to cover the surface of the core material, the encapsulated toner being produced by the method comprising the steps of coating the surface of the core material with a hydrophilic shell-forming material to form precursor particles; adding at least a vinyl polymerizable monomer and an initiator for vinyl polymerization to an aqueous suspension of the precursor particles to absorb them into the precursor particles; and then polymerizing the monomer components in the precursor particles.

DETAILED DESCRIPTION OF THE INVENTION

The method for production of an encapsulated toner for heat-and-pressure fixing of the present invention comprises two polymerization reaction steps, namely the first-step reaction and the second-step reaction. Specifically, the method of the present invention comprises:

(a) the first-step reaction, wherein the surface of the core material is coated with a hydrophilic shell-forming material, for instance, a shell-forming material predominantly containing an amorphous polyester, preferably by the in situ polymerization method to form precursor particles; and (b) the second-step reaction, wherein at least a vinyl polymerizable monomer and an initiator for vinyl polymerization are added to an aqueous suspension of the above precursor particles to absorb them into the precursor particles, and then the monomer components, in the above precursor particles are polymerized preferably by the seed polymerization method. Here, the "precursor particles" refer to particles which are precursors for the encapsulated toner to be subjected to the polymerization of the monomer components in the second-step reaction. In the present invention, these precursor particles may also be referred to as "encapsulated particles."

First, the precursor particles used in the present invention will be described below in detail. Since the core material of the precursor particles in the present invention becomes the core material of the encapsulated toner of the present invention, the core material of the precursor particles is a heat-fusible core material containing at least a thermoplastic resin and a coloring agent. The resin components of the core material in these precursor particles may have a crosslinked structure formed by using a crosslinking agent upon the preparation thereof as described below. Alternatively, the core material may be prepared without using any crosslinking agents. The precursor particles in the present invention are encapsulated particles which can be produced by coating the surface of the core material with a hydrophilic shell-forming material.

The hydrophilic shell-forming material refers to a material having such a property that the shell-forming material localizes onto the surface of the liquid droplets to form a shell when a mixed solution comprising the core material-constituting material and the hydrophilic shell-forming material is dispersed in an aqueous dispersant by the in situ polymerization. The hydrophilic shell-forming materials described above are not particularly restricted as long as they have the properties mentioned above. Examples of the hydrophilic shell-forming materials include vinyl resins having hydrophilic functional groups such as a carboxyl group, an acid anhydride group, a hydroxyl group, an amino group and an ammonium ion; an amorphous polyester; an amorphous polyester-amide; an amorphous polyamide; and an epoxy resin. Among them, a particular preference is given to the vinyl resins having acid anhydride groups and the amorphous polyester.

The present invention will be described in more detail below while showing a case where the hydrophilic shell-forming material predominantly contains a vinyl resin having acid anhydride groups or an amorphous polyester, but the present invention is not limited thereto.

Examples of the vinyl resins having acid anhydride groups described above include copolymers having one or more acid anhydride groups such as a copolymer obtained by copolymerizing an α,β-ethylenic copolymerizable monomer having an acid anhydride group and the other α,β-ethylenic copolymerizable monomer.

Here, examples of the α,β-ethylenic copolymerizable monomers having an acid anhydride group include itaconic anhydride, crotonic anhydride, and the compounds represented by the following formula:

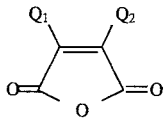

wherein $Q_1$ and $Q_2$ independently represents a hydrogen atom, an alkyl group having 1 to 3 carbon atoms or a halogen atom, which may be exemplified by maleic anhydride, citraconic anhydride, 2,3-dimethylmaleic anhydride, chloromaleic anhydride, dichloromaleic anhydride bromomaleic anhydride, and dibromomaleic anhydride, with a preference given to maleic anhydride and citraconic anhydride.

Also, examples of the other α,β-ethylenic copolymerizable monomers include the same ones as the polymerizable monomers constituting the vinyl resins used for the core material mentioned below.

On the other hand, the amorphous polyester in the present invention can generally be obtained by a condensation polymerization between at least one alcohol monomer selected from the group consisting of dihydric alcohol monomers and trihydric or higher polyhydric alcohol monomers and at least one carboxylic acid monomer selected from the group consisting of dicarboxylic acid monomers and tricarboxylic or higher polycarboxylic acid monomers. Among them, the amorphous polyesters obtained by the condensation polymerization of monomers containing a dihydric alcohol monomer and a dicarboxylic acid monomer, and further at least a trihydric or higher polyhydric alcohol monomer and/or a tricarboxylic or higher polycarboxylic acid monomer are suitably used. The amorphous polyester described above can be contained in an amount of normally 50 to 100% by weight, based on the total weight of the shell, and the other components which may be contained in the shell include the vinyl resins, amorphous polyamides, amorphous polyester-amides, and epoxy resins which have hydrophilic properties described above in an amount of 0 to 50% by weight.

Examples of the dihydric alcohol components include bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, propylene adduct of bisphenol A, ethylene adduct of bisphenol A, hydrogenated bisphenol A and other dihydric alcohols.

Examples of the trihydric or higher polyhydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-l,2,4-butanetriol, trimethylolethane, trimethylolpropane, 1,3,5-trihydroxymethylbenzene, and other trihydric or higher polyhydric alcohols. Among them, the trihydric alcohols are preferably used.

In the present invention, these dihydric alcohol monomers and trihydric or higher polyhydric alcohol monomers may be used singly or in combination.

As for the acid components, examples of the dicarboxylic acid components include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, n-dodecylsuccinic acid, n-octylsuccinic acid, isooctenylsuccinic acid, isooctylsuccinic acid, and acid anhydrides thereof, lower alkyl esters thereof and other dicarboxylic acids.

Examples of the tricarboxylic or higher polycarboxylic acid components include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, and acid anhydrides thereof, lower alkyl esters thereof and other tricarboxylic or higher polycarboxylic acids. In the present invention, among these carboxylic acid components, a preference is given to the tricarboxylic acids or the derivatives thereof.

These dicarboxylic acid monomers and tricarboxylic or higher polycarboxylic acid monomers may be used singly or in combination.

The method for producing an amorphous polyester in the present invention is not particularly limitative, and the amorphous polyester can be produced by esterification or transesterification of the above monomers.

Here, "amorphous" refers to those which do not have a definite melting point. When a crystalline polyester is used in the present invention, the amount of energy required for fusion is large, thereby making the fixing ability of the toner undesirably poor.

The glass transition temperature of the amorphous polyester thus obtained is preferably 50° to 80° C., more preferably 55° to 70° C. When the glass transition temperature is less than 50° C., the storage stability of the toner becomes poor, and when it exceeds 80° C., the fixing ability of the resulting toner becomes undesirably poor. In the present invention, the "glass transition temperature" used herein refers to the temperature of an intersection of the extension of the baseline of not more than the glass transition temperature and the tangential line showing the maximum inclination between the kickoff of the peak and the top thereof as determined using a differential scanning calorimeter ("DSC Model 200," manufactured by Seiko Instruments, Inc.), at a temperature rise rate of 10° C./min.

The acid value of the above amorphous polyester is an important factor for the purpose of controlling the balance between the hydrophilic property and the lipophilic property. In the present invention, the acid value is preferably 3 to 50 KOH mg/g, more preferably 10 to 30 KOH mg/g. When it is less than 3 KOH mg/g, the amorphous polyester used as the shell-forming material is less likely to be formed on the core material during the in situ polymerization, thereby making the storage stability of the resulting toner poor, and when it exceeds 50 KOH mg/g, the polyester is likely to shift to a water phase, thereby making the production stability poor. Here, the acid value is measured according to JIS K0070.

On the other hand, since the core material for the precursor particles used in the present invention becomes the core material for the encapsulated toner of the present invention as mentioned above, the core material for the precursor particles is a heat-fusible core material containing at least a thermoplastic resin and a coloring agent, which may contain other various components contained in the conventional toner.

The thermoplastic resins mentioned above include polyester resins, polyester-polyamide resins, polyamide resins and vinyl resins, with a preference given to the vinyl resins. The glass transition temperatures ascribed to the thermoplastic resin used as the main component of the heat-fusible core material described above are preferably 10° C. to 50° C., more preferably 20° C. to 40° C. When the glass transition temperature is less than 10° C., the storage stability of the encapsulated toner becomes poor, and when it exceeds 50° C., the fixing strength of the resulting encapsulated toner becomes undesirably poor. The glass transition temperature described above can be adjusted by the amounts of the resin monomers for the precursor particles, the polymerization conditions, etc. Also, it can be adjusted by the kinds of the vinyl polymerizable monomers absorbed into the precursor particles, the conditions for the second-step reaction, etc.

Among the above-mentioned thermoplastic resins, which may also be used as the vinyl polymerizable monomers absorbed into the precursor particles mentioned below, examples of the monomers constituting the vinyl resins include styrene and styrene derivatives such as styrene, o-methylstyrene, m-methylstyrene, p-methylstyrene, α-methylstyrene, p-ethylstyrene, 2,4-dimethylstyrene, p-chlorostyrene, and vinylnaphthalene; ethylenic unsaturated monoolefins such as ethylene, propylene, butylene and isobutylene; vinyl esters such as vinyl chloride, vinyl bromide, vinyl fluoride, vinyl acetate, vinyl propionate, vinyl formate, and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, t-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, t-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate and diethylaminoethyl methacrylate; substituted monomers of ethylenic monocarboxylic acids such as acrylonitrile, methacrylonitrile and acrylamide; ethylenic dicarboxylic acids and substituted monomers thereof such as dimethyl maleate; vinyl ketones such as vinyl methyl ketone; vinyl ethers such as vinyl methyl ether; vinylidene halides such as vinylidene chloride; and N-vinyl compounds such as N-vinylpyrrole and N-vinylpyrrolidone.

Among the above core material resin-constituting components according to the present invention, it is preferred that styrene or styrene derivatives is used in an amount of 50 to 90% by weight to form the main structure of the resins, and that the ethylenic monocarboxylic acid or esters thereof is used in an amount of 10 to 50% by weight to adjust the thermal properties such as the softening point of the resins, because the glass transition temperature of the core material resin can be controlled easily.

In the polymerizable monomer composition constituting the core material resin according to the present invention, a crosslinking agent is preferably contained. In the case of using a crosslinking agent, although the methods of using the crosslinking agents are not particularly limitative, there may be two embodiments:

In one embodiment, a crosslinking agent is added and reacted at the time of preparing the precursor particles (the first-step reaction), and a crosslinking agent is further added at the time of absorbing the polymerizable components into the precursor particles to utilize it in the polymerization by the second-step reaction. In another embodiment, a crosslinking agent is not added at the first-step reaction, and it is added only at the second-step reaction.

By adding the crosslinking agent and reacting it together with the other components as described above, the molecular weight distribution of the resin components constituting the core material can be adjusted, thereby effectively making the non-offset range wide. A particular preference is given to the embodiment where the crosslinking agents are added at both the first-step and second-step reactions for the reasons given below. In this case, a crosslinked structure is formed in the resin components constituting the core material in the precursor particles, and a crosslinked structure is further formed therein at the second-step reaction, so that the offset resistance can be remarkably improved not only in a high-speed fixing but also in a low-speed fixing.

Examples of crosslinking agents added include any of the generally known crosslinking agents such as divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl-)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate and diallyl phthalate. Among them, a preference is given to divinylbenzene and polyethylene glycol dimethacrylate. These crosslinking agents may be used alone or, if necessary, in a combination of two or more.

The amount of these crosslinking agents used is preferably 0.001 to 15% by weight, more preferably 0.1 to 10% by weight, based on the vinyl polymerizable monomers. Here, when the crosslinking agent is added at both the first-step reaction and the second-step reaction, the foregoing amount of the crosslinking agent is the total amount used for the both steps, and when the crosslinking agent is used only at the second-step reaction, the foregoing amount of the crosslinking agent is for the second-step reaction. When the amount of these crosslinking agents used is more than 15% by weight, the resulting toner is unlikely to be melted with heat, thereby resulting in poor heat fixing ability and poor heat-and-pressure fixing ability. On the contrary, when the amount used is less than 0.001% by weight, in the heat-and-pressure fixing, a part of the toner cannot be completely fixed on a paper but rather adheres to the surface of a roller, which in turn is transferred to a subsequent paper, namely an offset phenomenon takes place. Incidentally, when the crosslinking agents are added at both the first-step reaction and the second-step reaction, the amount of the crosslinking agent used at the first-step reaction is 0.1 to 5.0% by weight, preferably 0.5 to 3.0% by weight, and that used at the second-step reaction is 0.1 to 5.0% by weight, preferably 1.0 to 3.0% by weight.

A graft or crosslinked polymer prepared by polymerizing the above monomers in the presence of an unsaturated polyester may be also used as the resin for the core material.

Examples of the polymerization initiators to be used in the production of the thermoplastic resin for the core material, which may be also used as initiators for vinyl polymerization mentioned below to be absorbed into the precursor particles, include azo and diazo polymerization initiators such as 2,2'-azobis(2,4-dimethylvaleronitrile), 2,2'-azobisisobutyronitrile, 1,1'-azobis(cyclohexane-1-carbonitrile) and 2,2'-azobis-4-methoxy-2,4-dimethylvaleronitrile; and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide and dicumyl peroxide.

For the purposes of controlling the molecular weight or molecular weight distribution of the polymer or controlling the reaction time, two or more polymerization initiators may be used in combination. The amount of the polymerization initiator used is 0.1 to 20 parts by weight, preferably 1 to 10 parts by weight, based on 100 parts by weight of the monomers to be polymerized.

In the present invention, although the toner whose shell comprises an amorphous polyester has a negative chargeability, for the purpose of adjusting the amount of tribo electric charges, the charge control agent may be further added to the core material. Negative charge control agents to be added are not particularly limitative, and examples thereof include azo dyes containing metals such as "Varifast Black 3804" (manufactured by Orient Chemical), "Bontron S-31" (manufactured by Orient Chemical), "Bontron S-32" (manufactured by Orient Chemical), "Bontron S-34" (manufactured by Orient Chemical), "T-77" (manufactured by Hodogaya Kagaku) and "Aizenspilon Black TRH" (manufactured by Hodogaya Kagaku); copper phthalocyanine dye; metal complexes of alkyl derivatives of salicylic acid such as "Bontron E-81" (manufactured by Orient Chemical), "Bontron E-82" (manufactured by Orient Chemical), and "Bontron E-85" (manufactured by Orient Chemical); and quaternary ammonium salts such as "Copy Charge NX VP434" (manufactured by Hoechst); nitroimidazole derivatives, with a preference given to T-77.

The positive charge control agents are not particularly limitative, and examples thereof include nigrosine dyes such as "Nigrosine Base EX" (manufactured by Orient Chemical), "Oil Black BS" (manufactured by Orient Chemical), "Oil Black SO" (manufactured by Orient Chemical), "Bontron N-01" (manufactured by Orient Chemical), "Bontron N-07" (manufactured by Orient Chemical), and "Bontron N-11" (manufactured by Orient Chemical); triphenylmethane dyes containing tertiary amines as side chains; quaternary ammonium salt compounds such as "Bontron P-51" (manufactured by Orient Chemical), cetyltrimethylammonium bromide, and "Copy Charge PX VP435" (manufactured by Hoechst); polyamine resins such as "AFP-B" (manufactured by Orient Chemical); and imidazole derivatives, with a preference given to Bontron N-01.

The above charge control agents may be contained in the core material in an amount of 0.1 to 8.0% by weight, preferably 0.2 to 5.0% by weight.

If necessary, the core material may contain one or more suitable offset inhibitors for the purpose of improving the offset resistance in heat-and-pressure fixing, and examples of the offset inhibitors include polyolefins, metal salts of fatty acids, fatty acid esters, partially saponified fatty acid esters, higher fatty acids, higher alcohols, paraffin waxes, amide waxes, polyhydric alcohol esters, silicone varnish, aliphatic fluorocarbons and silicone oils.

Examples of the above polyolefins include resins such as polypropylene, polyethylene, and polybutene, which have softening points of 80° to 160° C. Examples of the above metal salts of fatty acids include metal salts of maleic acid with zinc, magnesium, and calcium; metal salts of stearic acid with zinc, cadmium, barium, lead, iron, nickel, cobalt, copper, aluminum, and magnesium; dibasic lead stearate; metal salts of oleic acid with zinc, magnesium, iron, cobalt, copper, lead, and calcium; metal salts of palmitic acid with aluminum and calcium; caprylates; lead caproate; metal salts of linoleic acid with zinc and cobalt; calcium ricinoleate; metal salts of ricinoleic acid with zinc and cadmium; and mixtures thereof. Examples of the above fatty acid esters include ethyl maleate, butyl maleate, methyl stearate, butyl stearate, cetyl palmirate, and ethylene glycol montanate. Examples of the above partially saponified fatty acid esters include montanic acid esters partially saponified with calcium. Examples of the above higher fatty acids include dodecanoic acid, lauric acid, myristic acid, palmitic acid, stearic acid, oleic acid, linoleic acid, ricinoleic acid, arachic acid, behenic acid, lignoceric acid and selacholeic acid, and mixtures thereof. Examples of the above higher alcohols include dodecyl alcohol, lauryl alcohol, myristyl alcohol, palmityl alcohol, stearyl alcohol, arachyl alcohol, and behenyl alcohol. Examples of the above paraffin waxes include natural paraffins, microcrystalline waxes, synthetic paraffins, and chlorinated hydrocarbons. Examples of the above amide waxes include stearamide, oleamide, palmitamide, lauramide, behenamide, methylenebisstearamide, ethylenebisstearamide, N,N'-m-xylylenebisstearamide, N,N'-m-xylylenebis-12-hydroxystearamide, N,N'-isophthalic bisstearylamide and N,N'-isophthalic bis-12-hydroxystearylamide. Examples of the above polyhydric alcohol esters include glycerol stearate, glycerol ricinolate, glycerol monobehenate, sorbitan monostearate, propylene glycol monostearate, and sorbitan trioleate. Examples of the above silicone varnishes include methylsilicone varnish, and phenylsilicone varnish. Examples of the above aliphatic fluorocarbons include low polymerized compounds of tetrafluoroethylene and hexafluoropropylene, and fluorinated surfactants disclosed in Japanese Patent Laid-Open No. 53-124428. Among the above offset inhibitors, a preference is given to the polyolefins, with a particular preference to polypropylene.

It is preferable to use the offset inhibitors in a proportion of 1 to 20% by weight, based on the resin contained in the core material.

In the present invention, a coloring agent is contained in the core material of the encapsulated toner, namely the precursor particles, and any of the conventional dyes or pigments, which have been used for coloring agents for the toners may be used.

Examples of the coloring agents used in the present invention include various carbon blacks which may be produced by a thermal black method, an acetylene black method, a channel black method, and a lamp black method; a grafted carbon black, in which the surface of carbon black is coated with a resin; a nigrosine dye, Phthalocyanine Blue, Permanent Brown FG, Brilliant Fast Scarlet, Pigment Green B, Rhodamine-B Base, Solvent Red 49, Solvent Red 146, and Solvent Blue 35, and the mixtures thereof. The coloring agent is usually used in an amount of about 1 to 15 parts by weight based on 100 parts by weight of the resin contained in the core material.

A magnetic encapsulated toner can be prepared by adding a particulate magnetic material to the core material. Examples of the particulate magnetic materials include ferromagnetic metals such as iron, i.e., ferrite or magnetite, cobalt, and nickel, alloys thereof, and compounds containing these elements; alloys not containing any ferromagnetic element which become ferromagnetic by suitable thermal treatment, for example, so-called "Heusler alloys" containing manganese and copper such as a manganese-copper-aluminum alloy, and a manganese-copper-tin alloy; and chromium dioxide, with a preference given to the compounds containing ferromagnetic materials, and a particular preference to magnetite. Such a magnetic material is uniformly dispersed in the core material in the form of a fine powder having an average particle diameter of 0.1 to 1 μm. The content of these magnetic materials is 20 to 70 parts by weight, preferably 30 to 70 parts by weight, based on 100 parts by weight of the encapsulated toner.

When a particulate magnetic material is incorporated into the core material in order to make it a magnetic toner, the material may be treated in a similar manner to that of the coloring agent. Since a particulate magnetic material as such is poor in the affinity for organic substances such as core materials and monomers, the material is used together with a known coupling agent such as a titanium coupling agent, a silane coupling agent or a lecithin coupling agent, with a preference given to the titanium coupling agent, or is treated with such a coupling agent prior to its use, thereby making it possible to uniformly disperse the particulate magnetic materials.

The precursor particles in the present invention are produced using the above starting materials preferably by the in situ polymerization method from the viewpoint of simplicity in the production facilities and the production steps (the first-step reaction).

The method for production of the precursor particles (encapsulated particles) by the in situ polymerization is described hereinbelow. In this method for production of the precursor particles in the present invention, the shell can be formed by utilizing such property that when a mixed solution comprising the core material-constituting material and the hydrophilic shell-forming material such as amorphous polyesters is dispersed in the aqueous dispersant, the hydrophilic shell-forming material localizes onto the surface of the liquid droplets. Specifically, the separation of the core material-constituting material and the hydrophilic shell-forming material in the liquid droplets of the mixed solution takes place due to the difference in the solubility indices, and the polymerization proceeds in this state to form an encapsulated structure. Thus, an aqueous suspension of the precursor particles, in which the hydrophilic shell-forming material is coated on the surface of the core material, can be obtained. By this method, since a shell is formed as a layer of hydrophilic shell-forming materials with a substantially uniform thickness, the tribo electric charge of the resulting toner becomes uniform. This property is particularly effective when the material having tribo electric charge such as an amorphous polyester is used as a shell-forming material.

More precisely, the precursor particles in the present invention can be produced by the following steps (a) to (c):

(a) dissolving a hydrophilic shell-forming material in a mixture comprising a core material-constituting material and a coloring agent;

(b) dispersing the mixture obtained in the step (a) in an aqueous dispersant to give a polymerizable composition; and (c) polymerizing the polymerizable composition obtained in the step (b) by the in situ polymerization.

In the case of the above method, a dispersion stabilizer is required to be contained in the dispersion medium in order to prevent agglomeration and incorporation of the dispersed substances.

Examples of the dispersion stabilizers include gelatin, gelatin derivatives, polyvinyl alcohol, polystyrenesulfonic acid, hydroxymethylcellulose, hydroxyethylcellulose, hydroxypropylcellulose, sodium carboxymethylcellulose, sodium polyacrylate, sodium dodecylbenzenesulfonate, sodium tetradecyl sulfate, sodium pentadecyl sulfate, sodium octyl sulfate, sodium allyl alkyl polyethersulfonate, sodium oleate, sodium laurate, sodium caprate, sodium caprylate, sodium caproate, potassium stearate, calcium oleate, sodium 3,3-disulfonediphenylurea-4,4-diazobisamino-β-naphthol-6-sulfonate, o-carboxybenzeneazodimethylaniline, sodium 2,2,5,5-tetramethyltriphenylmethane-4,4-diazobis-β-naphtholdisulfonate, colloidal silica, alumina, tricalcium phosphate, ferrous hydroxide, titanium hydroxide, and aluminum hydroxide, with a preference given to tricalcium phosphate and sodium dodecylbenzenesulfonate. These dispersion stabilizers may be used alone or in combination of two or more.

Examples of the dispersion media for the dispersion stabilizer include water, methanol, ethanol, propanol, butanol, ethylene glycol, glycerol, acetonitrile, acetone, isopropyl ether, tetrahydrofuran, and dioxane, among which water is preferably used as an essential component. These dispersion media can be used singly or in combination.

In the method for the production of the precursor particles (the first-step reaction using the in situ polymerization method), the amount of the hydrophilic shell-forming material such as the above amorphous polyester is normally 3 to 50 parts by weight, preferably 5 to 40 parts by weight, more preferably 5 to 30 parts by weight, based on 100 parts by weight of the core material. When it is less than 3 parts by weight, the resulting shell becomes too thin in its thickness, thereby making the storage stability of the obtained toner poor. When it exceeds 50 parts by weight, dispersed substances in the aqueous dispersant have an undesirably high viscosity, thereby making it difficult to produce fine drops, which in turn results in poor production stability.

In addition, for the purpose of charge control, the charge control agents exemplified above may be properly added to the shell-forming materials of the precursor particles, namely the shell-forming materials of the encapsulated toner, in the present invention. Alternatively, the charge control agent may be used in a mixture with a toner. In such a case, since the shell itself controls chargeability, the amount of these charge control agents, if needed, can be minimized.

Next, the method for production of an encapsulated toner for heat-and-pressure fixing of the present invention by a seed polymerization (the second-step reaction), using the precursor particles produced by the method described above, will be described below.

The method of the present invention comprises the steps of adding at least a vinyl polymerizable monomer and an initiator for vinyl polymerization to an aqueous suspension of the above precursor particles to absorb them into the precursor particles; and polymerizing the monomer components in the above precursor particles.

In the method of the present invention, when the precursor particles are produced by the in situ polymerization method described above, at least a vinyl polymerizable monomer and an initiator for vinyl polymerization are immediately added to the precursor particles in a suspending state, and the monomer and the initiator are absorbed into the precursor particles, so that a seed polymerization takes place with the monomer components in the precursor particles. By this method, the production steps can be simplified.

The vinyl polymerizable monomers, etc. which are added to be absorbed into the precursor particles may be used in a state of an aqueous emulsion.

The aqueous emulsion to be added can be obtained by emulsifying and dispersing the vinyl polymerizable monomer and the initiator for vinyl polymerization in water together with a dispersion stabilizer, which may further contain a crosslinking agent, an offset inhibitor and a charge control agent, etc.

The vinyl polymerizable monomers used in this second-step reaction may be the same ones as those used for the production of the precursor particles by the first-step reaction. Also, the initiators for vinyl polymerization, the crosslinking agents and the dispersion stabilizers may also be the same ones as those used for the production of the precursor particles. The amount of the crosslinking agent used in the second-step reaction is also as described above.

In order to further improve the storage stability of the toner, the hydrophilic shell-forming material such as the amorphous polyester described above may be added to the aqueous emulsion. In this case, the amount of the hydrophilic shell-forming material added is normally 1 to 20 parts by weight, preferably 3 to 15 parts by weight, based on 100 parts by weight of the core material. Therefore, there may be various embodiments. For instance, in one embodiment, an amorphous polyester is used as a hydrophilic shell-forming material in the first-step reaction, and an amorphous polyester is also added in the second-step reaction. In another embodiment, a vinyl resin having an acid anhydride group is used in the first-step reaction, and an amorphous polyester is added in the second-step reaction.

The aqueous emulsion described above can be prepared by uniformly dispersing the mixture using such devices as a ultrasonic vibrator.

The acid value of the amorphous polyester used in the second-step reaction, as in the case of that used in the first-step reaction, is preferably 3 to 50 KOH mg/g, more preferably 10 to 30 KOH mg/g. When it is less than 3 KOH mg/g, the amorphous polyester used as the shell-forming material is less likely to be formed on the core material during the seed polymerization, thereby making the storage stability of the resulting toner poor, and when it exceeds 50 KOH mg/g, the polyester is likely to shift to a water phase, thereby making the production stability poor. Here, the acid value is measured according to JIS K0070.

The amount of the aqueous emulsion added is adjusted so that the amount of the vinyl polymerizable monomer used is 10 to 200 parts by weight, based on 100 parts by weight of the precursor particles. When the vinyl polymerizable monomer is less than 10 parts by weight, sufficient effects for improving the fixing ability of the resulting toner cannot be achieved, and when it exceeds 200 parts by weight, it would be difficult to uniformly absorb the monomer components in the precursor particles.

By adding the aqueous emulsion thereto, the vinyl polymerizable monomer is absorbed into the precursor particles so that the swelling of the precursor particles takes place. In the second-step reaction in the present invention, the monomer components in the precursor particles are polymerized in the above state. This polymerization may be referred to as "seed polymerization," wherein the precursor particles are used as seed particles.

According to the method of the present invention described above, the following features are improved when compared with the case where the encapsulated toner is produced solely by the in situ polymerization method.

Specifically, the encapsulated toner produced by the in situ polymerization method has more excellent low-temperature fixing ability and storage stability than conventional toners, and by further carrying out the seed polymerization method, a shell is formed more uniformly by the principle of surface science, thereby achieving a further excellent storage stability. Also, since the polymerizable monomer in the core material can be polymerized in two steps, namely, the first-step reaction and the second-step reaction, the molecular weight of the thermoplastic resin in the core material can be easily controlled by using a suitable amount of the crosslinking agent, thereby making the low-temperature fixing ability and the offset resistance more excellent. In particular, a toner suitable not only for a high-speed fixing but also a low-speed fixing can be produced.

Although the particle diameter of the encapsulated toner produced by the method described above is not particularly limitative, the average particle diameter is usually 3 to 30 μm. The thickness of the shell of the encapsulated toner is preferably 0.01 to 1 μm. When the thickness of the shell is less than 0.01 μm, the blocking resistance of the resulting toner becomes poor, and when it exceeds 1 μm, the heat fusibility of the resulting toner becomes undesirably poor.

In the encapsulated toner of the present invention, a fluidity improver, or a cleanability improver may be used, if necessary. Examples of the fluidity improvers include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide and silicon nitride, with a preference given to finely powdered silica.

The finely powdered silica is a fine powder having Si-O-Si linkages, which may be prepared by either the dry process or the wet process. The finely powdered silica may be not only anhydrous silicon dioxide but also any one of aluminum silicate, sodium silicate, potassium silicate, magnesium silicate and zinc silicate, with a preference given to those containing not less than 85% by weight of $SiO_2$. Further, finely powdered silica surface-treated with a silane coupling agent, a titanium coupling agent, silicone oil, and silicone oil having amine in the side chain thereof can be used.

The cleanability improvers include fine powders of metal salts of higher fatty acids typically exemplified by zinc stearate or fluorocarbon polymers.

Further, for the purpose of controlling the developability of the encapsulated toner, finely powdered polymers of methyl methacrylate or butyl methacrylate may be added.

Furthermore, for the purpose of reducing electric resistance on the surface of the toner, a small amount of carbon black may be used. The carbon blacks may be those of conventionally known, including various kinds such as furnace black, channel black, and acetylene black.

When the encapsulated toner of the present invention contains a particulate magnetic material, it can be used alone as a developer, while when the encapsulated toner does not contain any particulate magnetic material, a non-magnetic one-component developer or a two-component developer can be prepared by mixing the toner with a carrier. Although the carrier is not particularly limitative, examples thereof include iron powder, ferrite, glass beads, those of above with resin coatings, and resin carriers in which magnetite fine powders or ferrite fine powders are blended into the resins. The mixing ratio of the toner to the carrier is 0.5 to 20% by weight. The particle diameter of the carrier is 15 to 500 μm.

When the encapsulated toner of the present invention is fixed on a recording medium such as paper by heat and pressure, an excellent fixing strength is attained. As for the heat-and-pressure fixing process to be suitably used in the fixing of the toner of the present invention, any one may be used as long as both heat and pressure are utilized. Examples of the fixing processes which can be suitably used in the present invention include a known heat roller fixing process; a fixing process as disclosed in Japanese Patent Laid Open No. 2-190870 in which visible images formed on a recording medium in an unfixed state are fixed by heating and fusing the visible images through the heat-resistant sheet with a heating means, comprising a heating portion and a heat-resistant sheet, thereby fixing the visible images onto the recording medium; and a heat-and-pressure process as disclosed in Japanese Patent Laid-Open No. 2-162356 in which the formed visible images are fixed on a recording medium through a film by using a heating element fixed to a support and a pressing member arranged opposite to the heating element in contact therewith under pressure.

In the method of the present invention, the toner, which is produced by the steps of coating the surface of the core material with a hydrophilic shell-forming material such as an amorphous polyester to form precursor particles to absorb them into the above precursor particles, and polymerizing the monomers, not only has improved storage stability but also is excellent in offset resistance, fixable at a low temperature in the method for heat-and-pressure fixing and is further capable of forming clear images free from background. Also, by having a crosslinked structure of the resin components in the core material, the offset resistance of the resulting toner is further improved not only in high-speed fixing but also in low-speed fixing.

EXAMPLES

The present invention is hereinafter described in more detail by means of the following working examples, comparative examples and test examples, but the present invention is not limited by these examples.

Resin Production Example 367.5 g of a propylene oxide adduct of bisphenol A (hereinafter abbreviated as "BPA•PO"), 146.4 g of an ethylene oxide adduct of bisphenol A (hereinafter abbreviated as "BPA•EO"), 126.0 g of terephthalic acid (hereinafter abbreviated as "TPA"), 40.2 g of dodecenyl succinic anhydride (hereinafter abbreviated as "DSA"), and 77.7 g of trimellitic anhydride (hereinafter abbreviated as "TMA") are placed in a two-liter four-necked glass flask equipped with a thermometer, a stainless steel stirring rod, a reflux condenser and a nitrogen inlet tube, and heated at 220° C. in a mantle heater under a nitrogen gas stream while stirring to react the above components.

The degree of polymerization is monitored from a softening point measured according to ASTM E 28-67, and the reaction is terminated when the softening point reaches 110° C. This resin is referred to as "Resin A."

The composition of Resin A is shown in Table 1. Also, the glass transition temperature of the obtained resin is measured by the differential scanning calorimeter ("DSC Model 220," manufactured by Seiko Instruments, Inc.), and its value is shown together with the softening point and the acid value in Table 2. The acid value is measured by the method according to JIS K0070.

Here, the "softening point" used herein refers to the temperature corresponding to one-half of the height (h) of the S-shaped curve showing the relationship between the downward movement of a plunger (flow length) and temperature, when measured by using a flow tester of the "koka" type manufactured by Shimadzu Corporation in which a 1 $cm^3$ sample is extruded through a nozzle having a dice pore size of 1 mm and a length of 1 mm, while heating the sample so as to raise the temperature at a rate of 6° C./min and applying a load of 20 $kg/cm^2$ thereto with the plunger.

TABLE 1

| | Monomer (mol %) | | | | |
|---|---|---|---|---|---|
| Resin | BPA.PO | BPA.EO | TPA | DSA | TMA |
| A | 70 | 30 | 50 | 10 | 27 |

TABLE 2

| Resin | Softening Point (°C.) | Glass Transition Temperature (°C.) | Acid Value (KOH mg/g) |
|---|---|---|---|
| A | 110 | 65 | 18 |

EXAMPLE 1

15.0 parts by weight of Resin A and 7.0 parts by weight of carbon black "#44" (manufactured by Mitsubishi Kasei Corporation) are added to a mixture comprising 69.0 parts by weight of styrene, 31.0 parts by weight of 2-ethylhexyl acrylate and 6.0 parts by weight of 2,2'-azobisisobutyronitrile. The obtained mixture is introduced into an attritor (Model MA-01SC, manufactured by Mitsui Miike Kakoki) and dispersed at 10° C. for 5 hours to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T. K. HOMO MIXER, Model M" (manufactured by Tokushu Kika Kogyo) at room temperature and a rotational speed of 10000 rpm for 2 minutes.

Next, a four-necked glass cap is set on the flask, and a reflux condenser, a thermometer, a nitrogen inlet tube and a stainless steel stirring rod are attached thereto. The flask is placed in an electric mantle heater. Thereafter, as a first-step reaction, the contents are heated to 85° C. and reacted at 85° C. for 10 hours in a nitrogen atmosphere while stirring to give seed particles. The seed particles are cooled to room temperature to give precursor particles.

Next, 40.7 parts by weight of an aqueous emulsion comprising 13.0 parts by weight of styrene, 7.0 parts by weight of 2-ethylhexyl acrylate, 0.4 parts by weight of 2,2'-azobisisobutyronitrile, 0.22 parts by weight of divinylbenzene, 0.1 parts by weight of sodium laurylsulfate and 20 parts by weight of water is added dropwise to an aqueous suspension containing the above precursor particles, the emulsion being prepared by a ultrasonic vibrator ("US-150," manufactured by Nippon Seiki Co., Ltd.), so that the precursor particles are swelled thereby. Immediately after the dropwise addition, when the emulsion is observed using an optical microscope, no emulsified droplets are found, confirming that swelling has finished in a remarkably short period of time. Thereafter, as a second-step polymerization, the contents are heated to 85° C. and reacted at 85° C. for 10 hours in a nitrogen atmosphere while stirring. After cooling the reaction product, the dispersing agent is dissolved into 10%-aqueous hydrochloric acid. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to give an encapsulated toner according to the present invention. This toner is referred to as "Toner 1."

The glass transition temperature ascribed to the resin contained in the core material is 27.4° C., and the softening point of Toner 1 determined by a flow tester is 108.2° C.

EXAMPLE 2

15.0 parts by weight of Resin A is added to a mixture comprising 69.0 parts by weight of styrene, 31.0 parts by weight of 2-ethylhexyl acrylate and 6.0 parts by weight of 2,2'-azobisisobutyronitrile, and Resin A is dissolved into the mixture. After completely dissolving Resin A, 20 parts by weight of styrene-grafted carbon black "GP-E-3" (manufactured by Ryoyu Kogyo) is added thereto, and the resulting mixture is dispersed for 1 hour using a magnetic stirrer to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T. K. HOMO MIXER, Model M" (manufactured by Tokushu Kika Kogyo).

Next, a four-necked glass cap is set on the flask, and a reflux condenser, a thermometer, a nitrogen inlet tube and a stainless steel stirring rod are attached thereto. The flask is placed in an electric mantle heater. Thereafter, as a first-step reaction, the contents are heated to 85° C. and reacted at 85° C. for 10 hours in a nitrogen atmosphere while stirring to give seed particles. The seed particles are cooled to room temperature to give precursor particles.

Next, a mixture comprising 26.0 parts by weight of styrene, 14.0 parts by weight of 2-ethylhexyl acrylate, 0.8 parts by weight of 2,2'-azobisisobutyronitrile and 0.40 parts by weight of divinylbenzene is added dropwise to an aqueous suspension containing the above precursor particles. Thereafter, as a second-step polymerization, the contents are heated to 85° C. and reacted at 85° C. for 10 hours in a nitrogen atmosphere while stirring. After cooling the reaction product, the dispersing agent is dissolved into 10%-aqueous hydrochloric acid. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to give an encapsulated toner according to the present invention. This toner is referred to as "Toner 2."

The glass transition temperature ascribed to the resin contained in the core material is 28.5° C., and the softening point of Toner 2 determined by a flow tester is 115.0° C.

EXAMPLE 3

15.0 parts by weight of Resin A is added to a mixture comprising 69.0 parts by weight of styrene, 31.0 parts by weight of 2-ethylhexyl acrylate and 6.0 parts by weight of 2,2'-azobisisobutyronitrile, and Resin A is dissolved into the mixture. After completely dissolving Resin A, 20 parts by weight of styrene-grafted carbon black "GP-E-3" (manufactured by Ryoyu Kogyo) is added thereto, and the resulting mixture is dispersed for 1 hour using a magnetic stirrer to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T. K. HOMO MIXER, Model M" (manufactured by Tokushu Kika Kogyo).

Next, a four-necked glass cap is set on the flask, and a reflux condenser, a thermometer, a nitrogen inlet tube and a stainless steel stirring rod are attached thereto. The flask is placed in an electric mantle heater. Thereafter, as a first-step reaction, the contents are heated to 85° C. and reacted at 85° C. for 10 hours in a nitrogen atmosphere while stirring to give seed particles. The seed particles are cooled to room temperature to give precursor particles.

Next, 42.7 parts by weight of an aqueous emulsion comprising 13.0 parts by weight of styrene, 7.0 parts by weight of 2-ethylhexyl acrylate, 0.4 parts by weight of 2,2'-azobisisobutyronitrile, 0.22 parts by weight of divinylbenzene, 2.0 parts by weight of Resin A, 0.1 parts by weight of sodium laurylsulfate and 20 parts by weight of water is added dropwise to an aqueous suspension containing the above precursor particles, the emulsion being prepared by a ultrasonic vibrator ("US-150," manufactured by Nippon Seiki Co., Ltd.). Thereafter, as a second-step polymerization, the contents are heated to 85° C. and reacted at 85° C. for 10 hours in a nitrogen atmosphere while stirring. After cooling the reaction product, the dispersing agent is dissolved into 10%-aqueous hydrochloric acid. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to give an encapsulated toner according to the present invention. This toner is referred to as "Toner 3."

The glass transition temperature ascribed to the resin contained in the core material is 28.0° C., and the softening point of Toner 3 determined by a flow tester is 108.5° C.

EXAMPLE 4

The same procedures as those of Example 1 are carried out up to the surface treatment step except that 15.0 parts by weight of a polyester-amide resin (molar ratio of propylene oxide adduct of bisphenol A/terephthalic acid/metaxylylenediamine=95/90/5, softening point: 105° C., glass transition temperature: 60° C., and acid value: 15 KOH mg/g) is used in the place of 15.0 parts by weight of Resin A to give an encapsulated toner according to the present invention. This toner is referred to as "Toner 4."

The glass transition temperature ascribed to the resin contained in the core material is 27.5° C., and the softening point of Toner 4 determined by a flow tester is 105.9° C.

EXAMPLE 5

15.0 parts by weight of Resin A is added to a mixture comprising 69.0 parts by weight of styrene, 31.0 parts by weight of 2-ethylhexyl acrylate, 6.0 parts by weight of 2,2'-azobisisobutyronitrile and 0.5 parts by weight of divinylbenzene, and Resin A is dissolved into the mixture. After completely dissolving Resin A, 20 parts by weight of styrene-grafted carbon black "GP-E-3" (manufactured by Ryoyu Kogyo) is added thereto, and the resulting mixture is dispersed for 1 hour using a magnetic stirrer to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T. K. HOMO MIXER, Model M" (manufactured by Tokushu Kika Kogyo).

Next, a four-necked glass cap is set on the flask, and a reflux condenser, a thermometer, a nitrogen inlet tube and a stainless steel stirring rod are attached thereto. The flask is placed in an electric mantle heater. Thereafter, as a first-step reaction, the contents are heated to 85° C. and reacted at 85° C. for 10 hours in a nitrogen atmosphere while stirring to give seed particles. The seed particles are cooled to room temperature to give precursor particles.

Next, 122.6 parts by weight of an aqueous emulsion comprising 26.0 parts by weight of styrene, 14.0 parts by weight of 2-ethylhexyl acrylate, 1.6 parts by weight of 2,2'-azobisisobutyronitrile, 0.8 parts by weight of divinylbenzene, 0.2 parts by weight of sodium laurylsulfate and 80 parts by weight of water is added dropwise to an aqueous suspension containing the above precursor particles, the emulsion being prepared by a ultrasonic vibrator ("US-150," manufactured by Nippon Seiki Co., Ltd.). Thereafter, as a second-step polymerization, the contents are heated to 85° C. and reacted at 85° C. for 10 hours in a nitrogen atmosphere while stirring. After cooling the reaction product, the dispersing agent is dissolved into 10%-aqueous hydrochloric acid. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to give an encapsulated toner according to the present invention. This toner is referred to as "Toner 5."

The glass transition temperature ascribed to the resin contained in the core material is 33.0° C., and the softening point of Toner 5 determined by a flow tester is 112.5° C.

EXAMPLE 6

15.0 parts by weight of Resin A is added to a mixture comprising 69.0 parts by weight of styrene, 31.0 parts by weight of 2-ethylhexyl acrylate, 6.0 parts by weight of 2,2'-azobisisobutyronitrile and 0.8 parts by weight of divinylbenzene, and Resin A is dissolved into the mixture. After completely dissolving Resin A, 20 parts by weight of styrene-grafted carbon black "GP-E-3" (manufactured by Ryoyu Kogyo) is added thereto, and the resulting mixture is dispersed for 1 hour using a magnetic stirrer to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T. K. HOMO MIXER, Model M" (manufactured by Tokushu Kika Kogyo).

Next, a four-necked glass cap is set on the flask, and a reflux condenser, a thermometer, a nitrogen inlet tube and a stainless steel stirring rod are attached thereto. The flask is placed in an electric mantle heater. Thereafter, as a first-step reaction, the contents are heated to 85° C. and reacted at 85° C. for 10 hours in a nitrogen atmosphere while stirring to give seed particles. The seed particles are cooled to room temperature to give precursor particles.

Next, 122.6 parts by weight of an aqueous emulsion comprising 26.0 parts by weight of styrene, 14.0 parts by weight of 2-ethylhexyl acrylate, 1.6 parts by weight of 2,2'-azobisisobutyronitrile, 0.8 parts by weight of divinylbenzene, 0.2 parts by weight of sodium laurylsulfate and 80 parts by weight of water is added dropwise to an aqueous suspension containing the above precursor particles, the emulsion being prepared by a ultrasonic vibrator ("US-150," manufactured by Nippon Seiki Co., Ltd.). Thereafter, as a second-step polymerization, the contents are heated to 85° C. and reacted at 85° C. for 10 hours in a nitrogen atmosphere while stirring. After cooling the reaction product, the dispersing agent is dissolved into 10%-aqueous hydrochloric acid. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to give an encapsulated toner according to the present invention. This toner is referred to as "Toner 6."

The glass transition temperature ascribed to the resin contained in the core material is 35.6° C., and the softening point of Toner 6 determined by a flow tester is 122.0° C.

EXAMPLE 7

15.0 parts by weight of Resin A is added to a mixture comprising 69.0 parts by weight of styrene, 31.0 parts by weight of 2-ethylhexyl acrylate, 6.0 parts by weight of 2,2'-azobisisobutyronitrile and 0.8 parts by weight of divinylbenzene, and Resin A is dissolved into the mixture. After completely dissolving Resin A, 20 parts by weight of styrene-grafted carbon black "GP-E-3" (manufactured by Ryoyu Kogyo) is added thereto, and the resulting mixture is dispersed for 1 hour using a magnetic stirrer to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T. K. HOMO MIXER, Model M" (manufactured by Tokushu Kika Kogyo).

Next, a four-necked glass cap is set on the flask, and a reflux condenser, a thermometer, a nitrogen inlet tube and a stainless steel stirring rod are attached thereto. The flask is placed in an electric mantle heater. Thereafter, as a first-step reaction, the contents are heated to 85° C. and reacted at 85° C. for 10 hours in a nitrogen atmosphere while stirring to give seed particles. The seed particles are cooled to room temperature to give precursor particles.

Next, 123.4 parts by weight of an aqueous emulsion comprising 26.0 parts by weight of styrene, 14.0 parts by weight of 2-ethylhexyl acrylate, 2.4 parts by weight of 2,2'-azobisisobutyronitrile, 0.8 parts by weight of divinylbenzene, 0.2 parts by weight of sodium laurylsulfate and 80 parts by weight of water is added dropwise to an aqueous suspension containing the above precursor particles, the emulsion being prepared by a ultrasonic vibrator ("US-150," manufactured by Nippon Seiki Co., Ltd.). Thereafter, as a second-step polymerization, the contents are heated to 85° C. and reacted at 85° C. for 10 hours in a nitrogen atmosphere while stirring. After cooling the reaction product, the dispersing agent is dissolved into 10%-aqueous hydrochloric acid. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to give an encapsulated toner according to the present invention. This toner is referred to as "Toner 7."

The glass transition temperature ascribed to the resin contained in the core material is 36.1° C., and the softening point of Toner 7 determined by a flow tester is 118.5° C.

COMPARATIVE EXAMPLE 1

3.5 parts by weight of 2,2'-azobisisobutyronitrile and 9.5 parts by weight of 4,4'-diphenylmethane diisocyanate "Millionate MT" (manufactured by Nippon Polyurethane Industry Co., Ltd.) are added to a mixture comprising 70.0 parts by weight of styrene, 30.0 parts by weight of 2-ethylhexyl acrylate, 1.0 part by weight of divinylbenzene, and 10.0 parts by weight of carbon black "#44" (manufactured by Mitsubishi Kasei Corporation). The obtained mixture is introduced into an attritor (Model MA-01SC, manufactured by Mitsui Miike Kakoki) and dispersed at 10° C. for 5 hours to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T. K. HOMO MIXER, Model M" (manufactured by Tokushu Kika Kogyo) at 5° C. and a rotational speed of 12000 rpm for 2 minutes.

Next, a four-necked glass cap is set on the flask, and a reflux condenser, a thermometer, a nitrogen inlet tube and a stainless steel stirring rod are attached thereto. The flask is placed in an electric mantle heater. A mixture solution of 7.5 parts by weight of ethylenediamine, 0.5 parts by weight of dibutyltin dilaurate and 40 g of ion-exchanged water is prepared, and the resulting mixture is dropped into the flask in a period of 30 minutes through the dropping funnel while stirring. Thereafter, the contents are heated to 80° C. and reacted at 80° C. for 10 hours in a nitrogen atmosphere while stirring. After cooling the reaction product, the dispersing agent is dissolved into 10%-aqueous hydrochloric acid. The resulting product is filtered, and the obtained solid is washed with water, dried under a reduced pressure of 20 mmHg at 45° C. for 12 hours and classified with an air classifier to give the encapsulated toner with an average particle size of 8 μm whose shell comprises a polyurea resin.

To 100 parts by weight of this encapsulated toner, 0.4 parts by weight of hydrophobic silica fine powder "Aerozil R-972" (manufactured by Nippon Aerozil Ltd.) is added and mixed to obtain an encapsulated toner. This toner is referred to as "Comparative Toner 1."

The glass transition temperature ascribed to the, resin contained in the core material is 33.5° C., and the softening point of Comparative Toner 1 determined by a flow tester is 137.0° C.

COMPARATIVE EXAMPLE 2

69.0 parts by weight of styrene, 31.0 parts by weight of 2-ethylhexyl acrylate, 7.0 parts by weight of carbon black "#44" (manufactured by Mitsubishi Kasei Corporation), 2.0 parts by weight of low-molecular weight polyethylene ("MITSUI HIWAX," manufactured by Mitsui Petrochemical Industries, Ltd.) and 1.5 parts by weight of a charge control agent ("Aizenspilon Black TRH," manufactured by Hodogaya Kagaku) are added together, and the obtained mixture is introduced into an attritor (Model MA-01SC, manufactured by Mitsui Miike Kakoki) and dispersed at 10° C. for 10 hours. 6.0 parts by weight of 2,2'-azobisisobutyronitrile is dissolved into the above dispersion to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T. K. HOMO MIXER, Model M" (manufactured by Tokushu Kika Kogyo).

Next, a four-necked glass cap is set on the flask, and a reflux condenser, a thermometer, a nitrogen inlet tube and a stainless steel stirring rod are attached thereto. The flask is placed in an electric mantle heater. Thereafter, as a first-step polymerization, the contents are heated to 85° C. and reacted at 85° C. for 10 hours in a nitrogen atmosphere while stirring to give seed particles. The seed particles are cooled to room temperature to give precursor particles.

Next, 40.7 parts by weight of an aqueous emulsion comprising 13.0 parts by weight of styrene, 7.0 parts by weight of 2-ethylhexyl acrylate, 0.4 parts by weight of 2,2'-azobisisobutyronitrile, 0.22 parts by weight of divinylbenzene, 0.1 parts by weight of sodium laurylsulfate and 20 parts by weight of water is added dropwise to an aqueous suspension containing the above precursor particles, the emulsion being prepared by a ultrasonic vibrator ("US-150," manufactured by Nippon Seiki Co., Ltd.). Thereafter, as a second-step polymerization, the contents are heated to 85° C. and reacted at 85° C. for 10 hours in a nitrogen atmosphere while stirring. After cooling the reaction product, the dispersing agent is dissolved into 10%-aqueous hydrochloric acid. The resulting product is filtered, and the obtained solid is washed with water, dried under a reduced pressure of 20 mmHg at 20° C. for 12 hours and classified with an air classifier to give a toner with an average particle size of 8 μm obtained by seed polymerization.

To 100 parts by weight of this synthetic toner, 0.4 parts by weight of hydrophobic silica fine powder, "Aerozil R-972" (manufactured by Nippon Aerozil Ltd.) is added and mixed to obtain a synthetic toner. This toner is referred to as "Comparative Toner 2."

The glass transition temperature ascribed to the resin contained in the core material is 30.6° C., and the softening point of Comparative Toner 2 determined by a flow tester is 109.0° C.

COMPARATIVE EXAMPLE 3

20 parts by weight of Resin A and 3.5 parts by weight of 2,2'-azobisisobutyronitrile are added to a mixture comprising 69.0 parts by weight of styrene, 31.0 parts by weight of 2-ethylhexyl acrylate, 0.9 parts by weight of divinylbenzene and 7.0 parts by weight of carbon black "#44" (manufactured by Mitsubishi Kasei Corporation). The obtained mixture is introduced into an attritor (Model MA-01SC, manufactured by Mitsui Miike Kakoki) and dispersed at 10° C. for 5 hours to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T. K. HOMO MIXER, Model M" (manufactured by Tokushu Kika Kogyo) at 5° C. and a rotational speed of 12000 rpm for 5 minutes.

Next, a four-necked glass cap is set on the flask, and a reflux condenser, a thermometer, a nitrogen inlet tube and a stainless steel stirring rod are attached thereto. The flask is placed in an electric mantle heater. Thereafter, the contents are heated to 85° C. and reacted at 85° C. for 10 hours in a nitrogen atmosphere while stirring. After cooling the reaction product, the dispersing agent is dissolved into 10%-aqueous hydrochloric acid. The resulting product is filtered, and the obtained solid is washed with water, dried under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to obtain a comparative encapsulated toner. This toner is referred to as "Comparative Toner 3."

The glass transition temperature ascribed to the resin contained in the core material is 30.6° C., and the softening point of Comparative Toner 3 determined by a flow tester is 125.5° C.

Test Example

Each of the toners obtained in Examples 1 to 7 and Comparative Examples 1 to 3 is evaluated with respect to the storage stability, the tribo electric charge, and the fixing ability. The test for the storage stability is evaluated using a toner alone, and the tests for the tribo electric charge and the fixing ability are evaluated using a developer, which is prepared by placing 6 parts by weight of each of the toners and 94 parts by weight of spherical ferrite powder coated with styrene-methyl methacrylate copolymer resin having a particle size of 250 mesh-pass and 400 mesh-on into a polyethylene container, and mixing the above components by rotation of the container on the roller at a rotational speed of 150 rpm for 20 minutes. The storage stability, the tribo electric charge and the fixing ability are evaluated by the following methods.

(1) Storage stability

The storage stability is determined by measuring 5 g of each toner in an aluminum cup having a diameter of 90 mm, keeping it standing for 24 hours under the conditions at a temperature of 50° C. and a relative humidity of 40%, and evaluating the extent of the generation of agglomeration. The results are shown in Table 3.

(2) Tribo electric charge

The tribo electric charge is measured by a blow-off type electric charge measuring device as described below. Specifically, a specific charge measuring device equipped with a Faraday cage, a capacitor and an electrometer is used. First, W (g) (about 0.15 to 0.20 g) of the developer prepared above is placed into a brass measurement cell equipped with a stainless screen of 500 mesh, which is adjustable to any mesh size to block the passing of the carrier particles. Next, after aspirating from a suction opening for 5 seconds, blowing is carried out for 5 seconds under a pressure indicated by a barometric regulator of 0.6 kgf/cm$^2$, thereby selectively removing only the toner from the cell.

In this case, the voltage of the electrometer after 2 seconds from the start of blowing is defined as V (volt). Here, when the electric capacitance of the capacitor is defined as C (μF), the tribo electric charge Q/m of this toner can be calculated by the following equation:

$$Q/m(\mu C/g)=C\times V/m$$

Here, m is the weight of the toner contained in W (g) of the developer. When the weight of the toner in the developer is defined as T (g) and the weight of the developer as D (g), the toner concentration in a given sample can be expressed as T/D×100(%), and m can be calculated as shown in the following equation:

$$m(g)=W\times(T/D)$$

The measurement results of the tribo electric charge of the developer prepared under normal conditions are shown in Table 3.

(3) Fixing ability

The fixing ability is evaluated by the method as described below. Specifically, each of the developers prepared as described above is loaded on a commercially available electrophotographic copying machine to develop images. The copying machine is equipped with a selene-arsenic photoconductor for Toners 1 to 7 and Comparative Toners 2 and 3, or an organic photoconductor for Comparative Toner 1; a fixing roller having a rotational speed of 255 mm/sec for Toners 1 to 4 and Comparative Toners 1 to 3, or a rotational speed of 80 m/sec for Toners 5 to 7; a fixing device with variable heat-and-pressure and temperature; and an oil applying device being removed from the copying machine. By controlling the fixing temperature from 70° C. to 240° C., the fixing ability and the offset resistance of the formed images are evaluated. The results are shown in Table 3.

The lowest fixing temperature used herein is the temperature of the fixing roller at which the fixing ratio of the toner exceeds 70%. This fixing ratio of the toner is determined by placing a load of 500 g on a sand-containing rubber eraser (LION No. 502) having a bottom area of 15 mm×7.5 mm which contacts the fixed toner image, placing the loaded eraser on a fixed toner image obtained in the fixing device, moving the loaded eraser on the image backward and forward five times, measuring the optical reflective density of the eraser-treated image with a reflective densitometer manufactured by Macbeth Co., and then calculating the fixing ratio from this density value and a density value before the eraser treatment using the following equation.

$$\text{Fixing ratio (\%)} = \frac{\text{Image density after eraser treatment}}{\text{Image density before eraser treatment}} \times 100$$

The offset resistance is evaluated by measuring the temperature of the low-temperature offset disappearance and the temperature of the high-temperature offset initiation. Specifically, copying tests are carried out by raising the temperature of the heat roller surface at an increment of 5° C. in the range from 70° C. to 240° C., and at each temperature, the adhesion of the toner onto the heat roller surface for fixing is evaluated with naked eyes.

TABLE 3

| | Tribo | Storage | Fixing Ability | |
|---|---|---|---|---|
| | Electric Charge (μC/g) | Stability (50° C. × 24 hours) | Lowest Fixing Temp. | Non-Offset Region |
| Toner 1 | −28 | Good | 105° C. | 100–220° C. |
| Toner 2 | −30 | Good | 110° C. | 100–220° C. |
| Toner 3 | −30 | Good | 105° C. | 100–220° C. |
| Toner 4 | −24 | Good | 107° C. | 100–220° C. |
| Toner 5 | −27 | Good | 85° C. | 70–220° C. |
| Toner 6 | −27 | Good | 90° C. | 80–240° C. |
| Toner 7 | −27 | Good | 86° C. | 70–240° C. |
| Comparative Toner 1 | +15 | Good | 200° C. | 100–220° C. |
| Comparative Toner 2 | −25 | Poor | 110° C. | 100–180° C. |
| Comparative Toner 3 | −25 | Good | 122° C. | 100–220° C. |

As is clear from Table 3, with respect to Toners 1 through 7 according to the present invention, although the values for the tribo electric charges are slightly higher than desired, excellent image quality is maintained. With respect to the storage stability (blocking resistance), Toners 1 to 7 according to the present invention and Comparative Toners 1 and 3 have an excellent storage stability, and whereas Comparative Toner 2 has a poor storage stability because it does not have an encapsulated structure and also because its glass transition temperature is low.

Further, in Toners 1 to 7 according to the present invention, all of them have low lowest fixing temperatures and wide non-offsetting regions. In particular, each of Toners 5 to 7 comprises a core material having a crosslinked structure, thereby having a wide non-offset region even in a low-speed fixing. On the other hand, in Comparative Toner 1, since the melting point of the polyurea resin used as the shell material is high (more than 300° C.), its lowest fixing temperature is high (200° C.). In Comparative Toner 2, even though the lowest fixing temperature is high, the non-offset region is slightly narrow. In Comparative Toner 3, although it has a good fixing ability, since the toner is not produced by seed polymerization, it still shows a poorer fixing ability than those of Toners 1 to 7 of the present invention.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for producing an encapsulated toner for heat-and-pressure fixing comprising a heat-fusible core material containing at least a thermoplastic resin and a coloring agent and a shell formed thereon so as to cover the surface of the core material, the method comprising the steps of:

coating the surface of the core material with a hydrophilic shell-forming material comprising an amorphous polyester having an acid value of 3 to 50 KOH mg/g as a main component to form precursor particles;

adding at least a vinyl polymerizable monomer and a vinyl polymerization initiator to an aqueous suspension of said precursor particles absorbing at least said vinyl polymerizable monomer and said vinyl polymerization initiator into said precursor particles; and polymerizing at least said vinyl polymerizable monomer in said precursor particles to further form a resin for the core material in said precursor particles.

2. The method according to claim 1, wherein the precursor particles are encapsulated particles obtained by coating the surface of the core material with the hydrophilic shell-forming material by means of in situ polymerization after dispersing the hydrophilic shell-forming material and a core material-constituting material in an aqueous dispersant.

3. The method according to claim 1, wherein the vinyl polymerizable monomer is added in a proportion ranging from 10 to 200 parts by weight, based on 100 parts by weight of the precursor particles.

4. The method according to claim 1, wherein a crosslinking agent is further added to the aqueous suspension of said precursor particles.

5. The method according to claim 1, wherein a crosslinking agent is added to a polymerizable monomer composition constituting the core material resin at the time of preparing the precursor particles, and the crosslinking agent is further added to the aqueous suspension of said precursor particles.

6. The method according to claim 1, wherein a hydrophilic shell-forming material is further added to the aqueous suspension of said precursor particles.

* * * * *